US009933168B2

(12) United States Patent
Sun et al.

(10) Patent No.: US 9,933,168 B2
(45) Date of Patent: Apr. 3, 2018

(54) AIR SUPPLY APPARATUS USED FOR AIR CONDITIONER AND AIR CONDITIONER INDOOR UNIT HAVING THE SAME

(71) Applicant: MIDEA GROUP CO., LTD., Foshan (CN)

(72) Inventors: Yunliang Sun, Foshan (CN); Xiangyang Li, Foshan (CN)

(73) Assignee: Midea Group Co., Ltd., Foshan (CN)

( * ) Notice: Subject to any disclaimer, the term of this patent is extended or adjusted under 35 U.S.C. 154(b) by 144 days.

(21) Appl. No.: 14/779,539

(22) PCT Filed: Jan. 21, 2014

(86) PCT No.: PCT/CN2014/071027
§ 371 (c)(1),
(2) Date: Sep. 23, 2015

(87) PCT Pub. No.: WO2014/190780
PCT Pub. Date: Dec. 4, 2014

(65) Prior Publication Data

US 2016/0084510 A1 Mar. 24, 2016

(30) Foreign Application Priority Data

May 31, 2013 (CN) ..... 2013 1 0215137
May 31, 2013 (CN) ..... 2013 1 0215147
(Continued)

(51) Int. Cl.

| | |
|---|---|
| ***F24F 1/00*** | (2011.01) |
| ***F04D 25/10*** | (2006.01) |
| ***F24F 7/007*** | (2006.01) |
| *F24F 13/20* | (2006.01) |

(52) U.S. Cl.
CPC ..... *F24F 1/0029* (2013.01); *F04D 25/10* (2013.01); *F24F 1/0007* (2013.01);
(Continued)

(58) Field of Classification Search
CPC ..... F24F 1/0007; F24F 1/0018; F24F 1/0029; F24F 11/0075; F24F 2013/205;
(Continued)

(56) References Cited

U.S. PATENT DOCUMENTS 2,813,673 A * 11/1957 Smith ..... F04D 25/105 403/312
3,881,402 A * 5/1975 Larkfeldt ..... F24F 7/007 237/46
(Continued)

FOREIGN PATENT DOCUMENTS

CN 102213480 A 10/2011
CN 202521752 U 7/2012
(Continued)

OTHER PUBLICATIONS

PCT/CN2014/071027,English Translation of the International Search Report and Written Opinion, dated May 6, 2014, 15 pages.

*Primary Examiner* — Christopher R Zerphey
(74) *Attorney, Agent, or Firm* — Lathrop Gage LLP

(57) ABSTRACT

An air supply apparatus used for an air conditioner, includes: an annular outer frame (21), having an outer surface formed as a partial spherical surface and having an accommodating space (24) therein; and the impeller assembly (22) provided in the accommodating space (24) and pivotally connected to the outer frame (21), in which the impeller assembly (22) has an air suction side and an air outlet side. Also disclosed is an air conditioner having the air supply apparatus.

10 Claims, 13 Drawing Sheets

(30) Foreign Application Priority Data

May 31, 2013 (CN) ..... 2013 1 0215180
May 31, 2013 (CN) ..... 2013 2 0313401 U
May 31, 2013 (CN) ..... 2013 2 0313555 U

(52) U.S. Cl.
CPC ..... *F24F 1/0018* (2013.01); *F24F 7/007* (2013.01); *F24F 2013/205* (2013.01)

(58) Field of Classification Search
CPC . F24F 2013/1446; F24F 13/065; F04D 25/10; F04D 25/105; B60H 1/3442; B25J 17/0241; B25J 17/025; F16H 19/08
USPC ..... 74/89.18, 439
See application file for complete search history.

(56) References Cited

U.S. PATENT DOCUMENTS 5,310,313 A * 5/1994 Chen ..... F04D 25/105 416/100
5,575,715 A * 11/1996 Norbury, Jr. ..... B60H 1/3442 454/286
6,213,715 B1 * 4/2001 Larochelle ..... F04D 25/105 416/1
9,255,722 B2 * 2/2016 Kim ..... F24F 1/0014
2011/0085903 A1 * 4/2011 He ..... F04D 25/105 415/213.1
2012/0183390 A1 * 7/2012 Pan ..... F04D 25/105 415/170.1
2014/0053591 A1 * 2/2014 Shin ..... F25D 21/14 62/285

FOREIGN PATENT DOCUMENTS

CN 103363587 A 10/2013
CN 103363588 A 10/2013
CN 103363589 A 10/2013
CN 203375534 U 1/2014
CN 203375535 U 1/2014
GB 1317252 A 5/1973
JP 0166524 U 4/1989
JP 05280779 A 10/1993
JP 5201517 B1 * 6/2013 ..... F24F 11/0078

* cited by examiner

AIR SUPPLY APPARATUS USED FOR AIR CONDITIONER AND AIR CONDITIONER INDOOR UNIT HAVING THE SAME

CROSS-REFERENCE TO RELATED APPLICATION

The present application is a national phase entry under 35 U.S.C. 371 of International Patent Application No. PCT/CN2014/071027, filed Jan. 21, 2014, which claims the benefit of and priority to Chinese Application No. 201310215137.4 filed May 31, 2013, No. 201310215147.8 filed May 31, 2013, No. 201320313555.2 filed May 31, 2013, No. 201310215180.0 filed May 31, 2013, and No. 201320313401.3 filed May 31, 2013, the entire disclosures of which are incorporated herein by reference.

FIELD

The present disclosure relates to a refrigeration equipment field, and more particularly to an air supply apparatus used for an air conditioner and an air conditioner indoor unit having the same.

BACKGROUND

Currently, a household air conditioner indoor unit is generally shown as FIG. 23, the air conditioner indoor unit includes a housing 100', an evaporator 101', a cross flow impeller 102', an air inlet 103' and an air outlet 104'. Because a thin and long cross flow impeller 102' and a fixed air channel 105' are employed to this air conditioner indoor unit, both of the draught direction and the air supply distance thereof are limited, even most air conditioner indoor units are provided with horizontal air guide blades 106' and vertical air guide blades 107'. When the impeller 102' is rotating, a volute centre is formed inside of the cross flow impeller 102'. A front volute tongue 108' and a back volute tongue 109' are used as demarcation points, a upper half part of the cross flow impeller 102' is a suction region and a lower half part thereof is a spitting-out region. The air is collected by the air channel 105' and then blowing off with diffusion, since the inertance of the flow at the exiting, the draught direction may be changed by changing the angles of the horizontal air guide blade 106' or the vertical air guide blade 107', the effect of the guiding thereof is limited. Using the air guide blades 106' and 107' to change the air direction at the same time, the air guide blade itself also may cause a big windage in the air channel 105'. Also, because the flow field is forcedly changed using the air guide blade 106' and 107', it is easier to provide a temperature difference on two sides of the air guide blades 106' and 107' to produce a condensation. The air outlet 104' is slender resulting in exited air dispersion, which is not facilitated to the concentration of air supply and affects the amenity of the room being adjusted consequently.

SUMMARY

The present disclosure seeks to solve at least one of the problems existing in the prior art. Accordingly, an object of the present disclosure is to provide an air supply apparatus used for an air conditioner, this air supply apparatus may be used for an air conditioner indoor unit so as to effectually change the air direction and carry out the wide angle and the concentration of air supply.

Another object of the present disclosure is to provide an air conditioner indoor unit having the air supply apparatus described above.

The air supply apparatus used for an air conditioner according to embodiments of a first aspect of the present disclosure includes: an annular outer frame having an outer surface formed as a partial spherical surface and having an accommodating space therein; and an impeller assembly provided in the accommodating space and pivotally connected to the outer frame, in which the impeller assembly has an air suction side and an air outlet side.

According to an embodiment of the present disclosure, the air supply apparatus further includes: a central part disposed in the accommodating space and coaxially provided with the outer frame; and a plurality of air guide blades arranged along a circumferential direction in the accommodating space, and an outer end of each air guide blade being connected to an inner surface of the outer frame and an inner end of each air guide blade being connected to an outer surface of the central part.

Alternatively, the plurality of the air guide blades, the central part and the outer frame are formed integrally.

The impeller assembly includes: an impeller, an electric motor driving the impeller, the electric motor being installed in the central part, an output shaft of the electric motor being connected to the impeller through the central part.

Preferably, the output shaft of the electric motor is coaxially provided with the central part.

Preferably, the air guide blade is located at the air outlet side of the impeller assembly.

Alternatively, the impeller is an axial flow impeller or a diagonal flow impeller.

According to an embodiment of the present disclosure, the central part comprises a casing with a groove, the groove being concave facing the air outlet side, in which the electric motor is installed in the groove and the output shaft thereof is connected to the impeller through a bottom wall of the groove.

According to an embodiment of the present disclosure, the air supply apparatus further includes a cover, in which the cover seals an open end of the groove.

The air supply apparatus according to embodiments of the present disclosure is used for an air conditioner indoor unit so as to effectually change the air direction and carry out the wide angle and the concentration of air supply, and then to make the air flow of the air conditioner indoor unit flow smoothly without increasing windage during the process of the air flow and a condensation phenomenon accompanied.

The air conditioner indoor unit according to embodiments of a second aspect of the present disclosure includes: a housing having an air outlet channel; the air supply apparatus used for an air conditioner according to the embodiment of the first aspect of the present disclosure, wherein the air supply apparatus is disposed in the air outlet channel and rotatable related to the housing; and an evaporator disposed in the housing and located at the air suction side of the impeller assembly of the air supply apparatus.

According to an embodiment of the present disclosure, the air outlet channel has an air outlet, an annular wall is provided at the air outlet, an inner surface of the annular wall is formed as a partial spherical surface, and the outer frame of the air supply apparatus is connected to the annular wall in a pivotal manner by a rotation apparatus, and wherein the air supply apparatus is rotatable along at least one axis of the air outlet.

Preferably, a spherical center of the annular wall coincides with that of the outer frame.

According to an embodiment of the present disclosure, the rotation apparatus includes: a first rotation mechanism connected to the annular wall in a movable manner; and a first driving mechanism driving the first rotation mechanism to rotate about a first axis.

In specific, the first rotation mechanism includes: a first shaft piece and a second shaft piece, the first shaft piece and the second shaft piece being disposed between the outer frame and the annular wall and provided on two opposite sides of the outer frame, respectively, the first shaft piece and the second shaft piece being connected to the outer frame and to the annular wall in a movable manner respectively, the first shaft piece and the second shaft piece having a co-axis with the first axis, in which the first driving mechanism drives at least one of the first shaft piece and the second shaft piece to rotate.

The first rotation mechanism further includes: two first damping rubber mats, the two first damping rubber mats being installed on the first shaft piece and the second shaft piece respectively.

The first driving mechanism includes: a first driving electric motor, an output shaft of the first driving electric motor being provided with a first gear; a first gear pair, the first gear pair being formed as a sector, a first end of the first gear pair having a first tooth engaged with the first gear and a second end being fixed on the first shaft piece.

According to an embodiment of the present disclosure, the rotation apparatus further includes a mounting bracket, the mounting bracket comprising a first mounting arm fixed to the outer frame, wherein the first shaft piece and the second shaft piece are connected to both ends of the first mounting arm respectively.

Preferably, an end of the first mounting arm corresponding to the first gear pair is provided with two support arms, the two support arms are extended outward from the corresponded end of the first mounting arm respectively, and free ends of the two support arms bend inward, facing each other, so as to form two fixing lugs; the first driving electric motor is provided with two mounting lugs, the two fixing lugs and the two mounting lugs are connected by a first fixing piece so as to install the first driving electric motor on the first mounting arm.

Alternatively, the first fixing piece is a screw, a rivet or a pin.

According to an embodiment of the present disclosure, the mounting bracket further includes a second mounting arm fixed to the first mounting arm in a cross manner, both ends of the second mounting arm being fixed with the annular wall respectively; the rotation apparatus further includes: a second rotation mechanism connected to the second mounting arm in a movable manner; and a second driving mechanism driving the second rotation mechanism to rotate about a second axis.

In specific, the second rotation mechanism includes: a third shaft piece and a fourth shaft piece, the third shaft piece and the fourth shaft piece being disposed between the outer frame and the annular wall and provided on two opposite sides of the outer frame respectively, the third shaft piece and the fourth shaft piece being fixed to the outer frame and being connected to the second mounting arm in a movable manner respectively, the third shaft piece and the fourth shaft piece having a co-axis with the second axis, in which the second driving mechanism drives at least one of the third shaft piece and the fourth shaft piece to rotate.

The second rotation mechanism further includes: two second damping rubber mats, the two second damping rubber mats being installed on the third shaft piece and the fourth shaft piece respectively.

The second driving mechanism includes: a second driving electric motor, an output shaft of the second driving mechanism being provided with a second gear; a second gear pair, the second gear pair being formed as a sector, a first end of the second gear pair having a second tooth engaged with the second gear and a second end being fixed on the third shaft piece.

Preferably, an end of the second mounting arm corresponding to the second gear pair is provided with a fixed arm, the second driving electric motor having two lugs, the two lugs are connected to the fixed arm by a second fixing piece so as to fix the second driving electric motor on the fixed arm.

Alternatively, the second fixing piece is a screw, a rivet or a pin.

According to an embodiment of the present disclosure, the outer frame includes a first frame part and a second frame part installed outward on the first frame part, the third shaft piece and the fourth shaft piece being connected to the first frame part, and both ends of the second mounting arm extending into a space between the first frame part and the second frame part.

Preferably, the second gear pair bends as a shape of a spherical surface, a radian of the second gear pair coincides with that of the outer frame.

Preferably, a central angle of a sector of the second gear pair is greater than a central angle of the sector of the first gear pair.

Preferably, a cross connection of the first mounting arm and the second mounting arm is located at a spherical center of the outer surface of the outer frame.

According to an embodiment of the present disclosure, there is at least one air supply apparatus.

According to an embodiment of the present disclosure, there are a plurality of air outlets and a plurality of air supply apparatuses, in which the plurality of air outlets correspond to the plurality of air supply apparatuses respectively, and each air supply apparatus pivots about an axis of a corresponding air outlet.

According to an embodiment of the present disclosure, the air conditioner indoor unit is an air conditioner with an air outlet located on a top thereof.

According to an embodiment of the present disclosure, the air conditioner indoor unit is a hanging conditioner.

Alternatively, the evaporator is a straight tube fin evaporator or a micro-channel parallel flow evaporator.

According to an embodiment of the present disclosure, the air conditioner indoor unit is a floor type air conditioner.

With the air conditioner indoor unit according to embodiments of the present disclosure, the air supply apparatus is mounted on the annular wall of the air outlet as a whole. In particular, the air supply apparatus is rotating back and forth by the first rotation mechanism in a first plane, and the air supply apparatus is rotating back and forth by coupling the second rotation mechanism and the mounting bracket in a second plane, so that the entire air supply apparatus may be rotating at the air outlet to change the draught direction, which can be effective in changing draught direction. The rotation in the two planes of the air supply apparatus achieves a wide angle air supply, and the air supply apparatus can be located in a particular rotational direction so as to achieve a concentration of air supply. The change of the draught direction is caused by the changing of the rotation position of the air supply apparatus at the air outlet, not caused by providing the guide air blade. Therefore, the air flow of the air conditioner indoor unit flows smoothly, and there is no increase of the windage during the process of air flow nor a condensation phenomenon accompanied.

Additional aspects and advantages of the present disclosure will be given partially in the following description, part will become apparent in the following description, or be learned by practice of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

Figure 1:
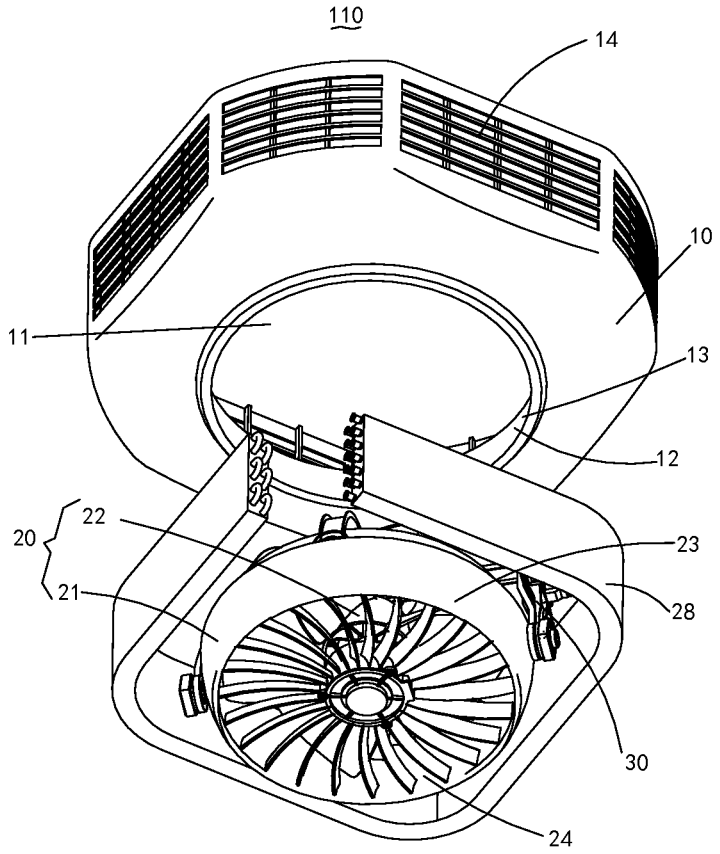
FIG. 1 is a steric exploded view showing an air conditioner indoor unit according to an embodiment of the present disclosure, in which the air conditioner indoor unit is an air conditioner with an air outlet located on a top thereof.

REFERENCE SIGNS an air conditioner indoor unit 110, 120, 130;
a housing 10;
an air supply apparatus 20; an outer frame 21; an impeller assembly 22; an impeller 220; an electric motor 221;
an accommodating space 24; a central part 25; a groove 250; a casing 251; an air guide blade 26; a cover 27;
a first rotation mechanism 31; a first gear pair 32; a first driving electric motor 33;
a first shaft piece 34; a second shaft piece 35; a first damping rubber mat 36; a first gear 37;
a second rotation mechanism 40; a second gear pair 43; a second driving electric motor 44; a fixed arm 47;
a mounting bracket 50; a first mounting arm 51; a second mounting arm 52; a support arm 60.

DETAILED DESCRIPTION

Embodiments of the present disclosure will be described in detail and examples of the embodiments will be illustrated in the drawings, where same or similar reference signs are used to indicate same or similar members or members with same or similar functions. The embodiments described herein with reference to drawings are explanatory, which are used to illustrate the present disclosure, but shall not be construed to limit the present disclosure.

In the specification, it should be understood that, the terms such as "central", "upper", "lower", "front", "rear", "right", "left", "vertical", "horizontal", "top", "bottom", "inner", "outer", should be construed to refer to the orientation as then described or as shown in the drawings. These terms are merely for convenience and concision of description and do not alone indicate or imply that the device or element referred to must have a particular orientation. Thus, it cannot be understood to limit the present disclosure.

In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this feature. In the description of the present disclosure, "a plurality of" means two or more than two this features, unless specified otherwise.

With Reference to FIG. 1-FIG. 19, the air supply apparatus 20 used for an air conditioner according to embodiments of the first aspect of the present disclosure is described. The air supply apparatus 20 can be used for an air conditioner indoor unit, e.g. an air conditioner with an air outlet located on a top thereof (such as FIG. 2), a hanging conditioner (such as FIG. 12-FIG. 18) or a floor type air conditioner (i.e. packaged air conditioner, such as shown in FIG. 19-FIG. 22). The air supply apparatus used for an air conditioner with an air outlet located on a top thereof will be taken as an example to illustrate the air supply apparatus in detail below, and of course, the same principle is used in a hanging conditioner or a floor type air conditioner. As shown in FIG. 2, the air conditioner indoor unit 110 includes a housing 10, an air outlet channel (not shown in figures) formed in the housing 10 and an air supply apparatus 20 for the air conditioner mounted in the air outlet channel of the housing 10 to change the draught direction, and the air supply apparatus 20 is rotatable related to the draught direction of the air outlet channel.

Specifically, the air supply apparatus 20 used for an air conditioner according to the embodiment of the present invention includes an annular outer frame 21 and an impeller assembly 22. The outer frame 21 has an outer surface formed as a partial spherical surface, i.e. a part of the spherical surface, and the outer frame 21 has an accommodating space 24 therein. The impeller assembly 22 and the outer frame 21 can be provided pivotally in the accommodating space 24, and the impeller assembly 22 has an air suction side and an air outlet side. When the air conditioner indoor unit 110 is supplying air, the independent air supply apparatus 20 is directly used for the air conditioner indoor unit 110 as a whole so as to facilitate to supply air. The "independent" described here means that the air supply apparatus 20 can be used for the air conditioner indoor unit 110 as an individual unit.

The related position between the impeller assembly 22 and the outer frame 21 of the air supply apparatus 20 is not changed, and the air supply apparatus 20, which is as a whole, is rotatable related to the draught direction of the air outlet channel, which changes the draught direction of the air outlet channel effectively and carries out a wide angle and a concentration of the air supply. The change of the air direction is caused by the changing of the position of the impeller related to the air outlet channel. Therefore, the air flow of the air conditioner indoor unit 110 flows smoothly, and there is no increase of the windage during the process of air flow nor a condensation phenomenon accompanied.

The air supply apparatus 20 according to an embodiment of the present disclosure further includes a central part 25 and a plurality of air guide blades 26. The central part 25 is disposed in the accommodating space and coaxially provided with the outer frame 21, i.e. disposed at the symmetry axis of the outer frame 21. The plurality of air guide blades 26 are arranged along a circumferential direction in the accommodating space, and an outer end of each air guide blade 26 is connected to an inner surface of the outer frame 21 and an inner end of each air guide blade 26 is connected to an outer surface of the central part 25, in other words, the plurality of air guide blades 26 radially extend from the periphery of the central part 25 to the inner surface of the outer frame 21. The central part 25 is connected to the outer frame 21 by the air guide blades 26, which makes the central part 25 be supported to the central portion of the air path of the outer frame 21. Preferably, the plurality of the air guide blades 26, the central part 25 and the outer frame 21 are formed integrally.

Specifically, the impeller assembly 22 includes an impeller 220 and an electric motor 221 driving the impeller 220. The electric motor 221 is installed in the central part 25, and an output shaft 222 of the electric motor 221 is connected to the impeller 220 through the central part 25 so as to drive the impeller 220 to rotate. Preferably, the output shaft 222 of the electric motor 221 is coaxially provided with the central part 25. Because the impeller 220 of the impeller assembly 20 has an air suction side and an air outlet side, the air guide blade 26 is located at the air outlet side of the impeller 220, the object of changing the air flow direction and increasing the static pressure can be achieved. Alternatively, the impeller 220 is an axial flow impeller or a diagonal flow impeller. Of course, it is understood by the skilled in the art, the impeller 220 is not limited in the two kind of the axial flow impeller or the diagonal flow impeller.

In the present embodiment, the central part 25 includes a casing 251 with a groove 250, and the air guide blade 26 is connected to the periphery of the outer frame 21 of the casing 251 in the symmetry axis direction of the outer frame 21. The groove 250 is concave facing the air outlet side, in which the electric motor 221 is installed in the groove 250 and the output shaft thereof is connected to the impeller 220 through a bottom wall of the groove 250. The air supply apparatus 20 further includes a cover 27, and the cover 27 seals an open end of the groove 250. The cover 27 covers the electric motor 221 in the groove 250 of the central part 25.

The air supply apparatus according to embodiments of the present disclosure is used for an air conditioner indoor unit so as to change the air direction and carry out the wide angle and the concentration of air supply, and then to make the air flow of the air conditioner indoor unit flow smoothly without increasing windage during the process of the air flow nor a condensation phenomenon accompanied.

With Reference to FIG. 1-FIG. 22, the air conditioner indoor unit according to embodiments of the second aspect of the present disclosure is described.

An air conditioner indoor unit according to an embodiment of the present disclosure includes a housing 10, the air supply apparatus 20 used for an air conditioner according to the embodiments described above and an evaporator 28. The housing 10 has an air outlet channel (not shown in the figures). The air supply apparatus 20, which is as a whole, is disposed in the air outlet channel and rotatable related to the housing 10. The evaporator 28 is disposed in the housing 10 and located at the air suction side of the impeller assembly 22 of the air supply apparatus 20. The air supply apparatus 20 is in front of the evaporator 28. The air flow is made to flow through the evaporator 28 first, and then through the air supply apparatus 20 and the air flow vented from the air conditioner indoor unit 110 is the air flow undergone heat transfer.

Alternatively, the air outlet channel has an air outlet 11, an annular wall 12 is provided at the air outlet 11, an inner surface of the annular wall 12 is formed as a partial spherical surface, and the outer frame 21 of the air supply apparatus 20 is connected to the annular wall 12 in a pivotal manner by a rotation apparatus 30, and in which the air supply apparatus 20 is rotatable along at least one axis of the air outlet 11, i.e. the air supply apparatus 20 related to the draught direction of the air outlet channel is rotatable in at least one plane, thus, the air supply is carried out in at least one plane. When the air supply apparatus 20 is rotatable in a plurality of planes, the plurality of planes do not coincide with each other. Of course, in other embodiments, it is not necessary that the independent air supply component 20 is provided at the air outlet 11 as long as it is installed in the air outlet channel rotatably and changes the draught direction.

Figure 4:
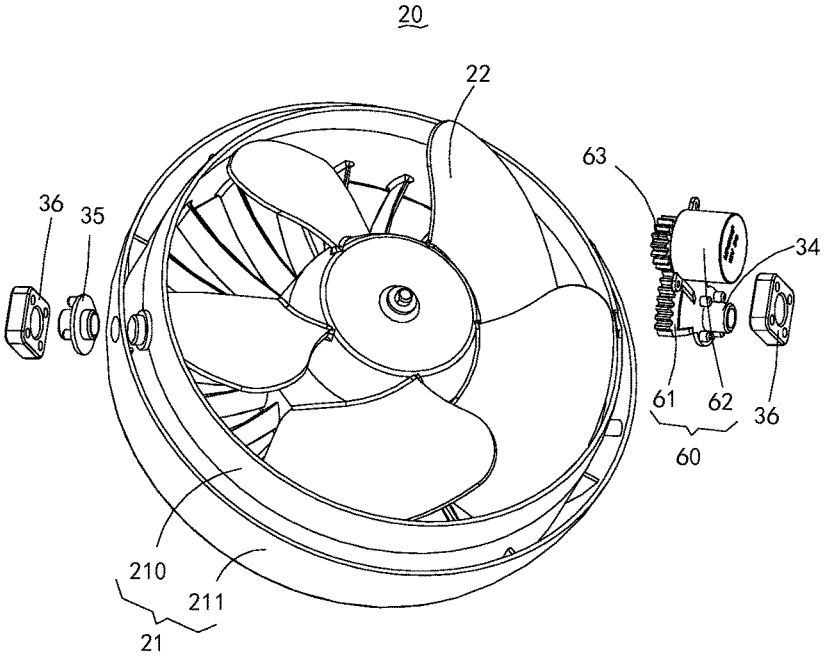
FIG. 4 is a steric exploded view showing an air supply apparatus of an air conditioner indoor unit according to an embodiment of the present disclosure, in which the air supply apparatus is only rotatable in an up-down direction.
Figure 5:
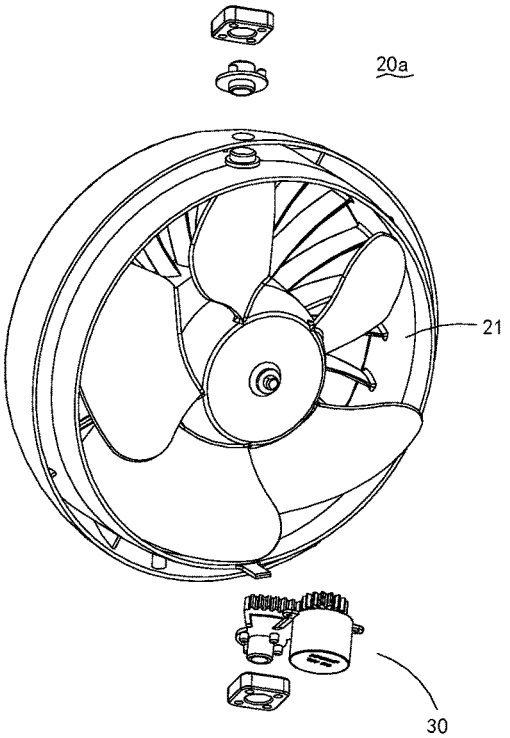
FIG. 5 is a steric exploded view showing an air supply apparatus of an air conditioner indoor unit according to another embodiment of the present disclosure, in which the air supply apparatus is only rotatable in a left-right direction.

Such as shown in FIG. 4, the air supply apparatus 20 is rotatable in an up-down direction related to the draught direction of the air outlet channel, at this time the air supply apparatus 20 is rotatable about the axis of the air outlet 11 along a left-right direction in FIG. 4; as shown in FIG. 5, the air supply apparatus 20 is rotatable in a left-right direction related to the draught direction of the air outlet channel, at this time the air supply apparatus 20 is rotatable about the axis of the air outlet 11 along an up-down direction in FIG. 5. However, as shown in FIG. 6-FIG. 11, the air supply apparatus 20 is rotatable both in an up-down and a left-right direction related to the draught direction of the air outlet channel. In the description described above and below of the present disclosure, the air supply apparatus 20 being rotatable in a left-right direction related to the draught direction of the air outlet channel is defined as the air supply apparatus being rotatable in the first plane (as shown in FIG. 4), and the air supply apparatus 20 being rotatable in an up-down direction related to the draught direction of the air outlet channel is defined as the air supply apparatus being rotatable in the second plane (as shown in FIG. 5).

When the air supply apparatus 20 supplies air only in one plane, the air conditioner indoor unit 110 may use at least two air supply apparatuses 20 described above, and a portion of air supply apparatus 20 is rotatable in the first plane and other portion of air supply apparatus 20 is rotatable in the second plane. The second plane is different from the first plane, which may also carry out air supply in the two different planes, such as shown in FIG. 12, FIG. 16-FIG. 18.

Because the outer surface 23 of the outer frame 21 is a spherical surface and the inner surface 13 of the annular wall 12 is also a spherical surface, preferably, the outer frame 21 is rotatably concentrically installed on the annular wall 12. The term "concentrically" here means a spherical center of the spherical surface of the outer frame 21 coincides with that of the spherical surface of the annular wall 12. Because the outer frame 21 is rotatably concentrically installed on the annular wall 12, when the outer frame 21 rotates related to the annular wall 12, the outer spherical surface 23 of the outer frame 21 can always keep a constant gap with the inner spherical surface 13 of the annular wall 12, which may avoid the interference between the outer frame 21 and the annular wall 12 in the rotation process. Furthermore, the gap between the outer spherical surface 23 of the outer frame 21 and the inner spherical surface 13 of the annular wall 12 may be small by making so as to ensure the requirement of sealing between outer frame 21 and the annular wall 12.

As shown in FIG. 4-FIG. 5, the rotation apparatus 30 includes a first rotation mechanism 31 and a first driving mechanism. The first rotation mechanism 31 is connected to the annular wall 12 in a movable manner, and the first driving mechanism drives the first rotation mechanism 31 to rotate about a first axis (e.g. an up-down radial axis and a left-right radial axis of the air outlet 11). The first axis is the rotation central axis of the air supply apparatus 20 related to the annular wall 12.

Specifically, the first rotation mechanism 31 includes a first shaft piece 34 and a second shaft piece 35. The first shaft piece 34 and the second shaft piece 35 are disposed between the outer frame 21 and the annular wall 12 and provided on two opposite sides of the outer frame 21, respectively, the first shaft piece 34 and the second shaft piece 35 are connected to the outer frame 21 and to the annular wall 12 in a movable manner respectively, and the first shaft piece 34 and the second shaft piece 35 have a co-axis with the first axis. The first driving mechanism drives at least one of the first shaft piece 34 and the second shaft piece 35 to rotate. The first driving mechanism includes a first driving electric motor 33 and a first gear pair 32. An output shaft of the first driving electric motor 33 is provided with a first gear 37. The first gear pair 32 is formed as a sector, and a first end of the first gear pair 32 has a first tooth 38 engaged with the first gear 37 and a second end is fixed on the first shaft piece 34.

According to one embodiment of the present disclosure, a first end of the first shaft piece 34 is fixedly installed on the outer frame 21, and a second end thereof is installed on the corresponded annular wall 12 in a movable manner; a first end of the second shaft piece 35 is fixedly installed on the outer frame 21, and a second end thereof is installed on the corresponded annular wall 12 in a movable manner, as shown in FIG. 4 and FIG. 5, at this time, the air supply apparatus only supplies air in one plane.

Alternatively, as shown in FIG. 6-FIG. 11, the rotation apparatus 30 further includes a mounting bracket 50, the mounting bracket 50 including a first mounting arm 51 fixed to the outer frame 21, in which the first shaft piece 34 and the second shaft piece 35 are connected to both ends of the first mounting arm 51 respectively. Furthermore, the first rotation mechanism 31 further includes two first damping rubber mats 36. The two first damping rubber mats are installed on the first shaft piece 34 and the second shaft piece 35 respectively, in which the damping rubber mats 36 installed on the first shaft piece 34 is located between the first gear pair 32 and the annular wall 12, the damping rubber mats 36 installed on the second shaft piece 35 is located between the corresponded end of the first mounting arm 51 and the annular wall 12 so as to achieve the object of reducing vibration and noise.

Specifically, an end of the first mounting arm corresponding to the first gear pair 32 is provided with two support arms 60, the two support arms 60 are extended outward from the corresponded end of the first mounting arm 51 respectively, and free ends of the two support arms 60 bend inward, facing each other, so as to form two fixing lugs 61; the first driving electric motor 33 is provided with two mounting lugs 330, the two fixing lugs 61 and the two mounting lugs 330 are connected by a first fixing piece (not shown in the figures) so as to install the first driving electric motor 33 on the first mounting arm 51. At this time, the first gear 37 is located between the two support arms 60. Alternatively, the first fixing piece is a screw, a rivet or a pin.

When the first driving electric motor 33 is working, the first gear 37 rotates and drives the first gear pair 32 to rotate. However, when the first gear pair 32 is rotating, because the first gear pair 32 is fixed with the first shaft piece 34, and the first shaft piece 34 and the second shaft piece 35 are installed on the annular wall 12 rotatably, when the first gear pair 32 is driven to rotate by the first driving electric motor 33, both of the first shaft piece 34 and the second shaft piece 35 rotate related to the annular wall 12, which makes the first gear pair 32 correspond to the first rotation central axis, and the two opposite ends of the first mounting arm 51 are fixedly connected to the first shaft piece 34 and the second shaft piece 35 respectively. When the first shaft piece 34 and the second shaft piece 35 rotate at the same time related to the annular wall 12, the first mounting arm 51 rotates related to the first axis.

However, according to further embodiments of the present disclosure, the air supply apparatus 20 can carry out air supply in two planes based on the mounting bracket 50 having the first mounting arm 51. By this time, the mounting bracket 50 further includes a second mounting arm 52 fixed to the first mounting arm 51 in a cross manner, both ends of the second mounting arm 52 being fixed with the annular wall 12 respectively. The rotation apparatus 30 further includes a second rotation mechanism 40 and a second driving mechanism. The second rotation mechanism 40 may be connected to the second mounting arm 52 in a movable manner, and the second driving mechanism drives the second rotation mechanism 40 to rotate about a second axis. Because the second mounting arm 52 is fixed to the first mounting arm 51 in a cross manner, when the first mounting arm 51 rotates related to the first rotation central axis, the second mounting arm 52, the outer frame 21 and the second rotation mechanism 40 rotate therewith. Thus, the rotation in the first plane is associated with the rotation in the second plane so as to carry out air supply by rotation in the two different planes. Preferably, a cross connection of the first mounting arm 51 and the second mounting arm 52 is located at a spherical center of the outer surface of the outer frame 21.

Preferably, the first axis is orthogonal to the second axis. As shown in FIG. 8-FIG. 11, the first axis is the radial axis extending along an up-down direction, and the second axis is the radial axis extending along a left-right direction, which is to say, the first mounting arm 51 drives the air supply apparatus to rotate in a left-right direction about the first axis, i.e. rotate in the first plane; the second mounting arm 52 drives the air supply apparatus to rotate in an up-down direction about the second axis, i.e. rotate in the second plane.

In this way, the air supply apparatus 20 rotates back and forth by the first rotation mechanism 31 in a first plane, and the air supply apparatus 20 rotates back and forth by coupling the second rotation mechanism 40 and the mounting bracket 50 in a second plane, so that the entire air supply apparatus 20 may be rotated on the air outlet 11 to change the draught direction, which can be effective in changing draught direction. The rotation of the air supply apparatus in the two planes achieves a wide angle air supply, and the air supply apparatus 20 can be located on a certain rotational direction so as to carry out a concentration of air supply. The change of the draught direction is caused by the changing of the rotation position of the air supply apparatus 20 at the air outlet 11, instead of providing the guide air blade. Therefore, the air flow of the air conditioner indoor unit 110 flows smoothly, and there is no increase of the windage during the process of air flow nor a condensation phenomenon accompanied.

Specifically, the second rotation mechanism 40 includes: a third shaft piece (not shown in the figures) and a fourth shaft piece (not shown in the figures), the third shaft piece and the fourth shaft piece being disposed between the outer frame 21 and the annular wall 12 and provided on two opposite sides of the outer frame 21 respectively, the third shaft piece and the fourth shaft piece being fixed to the outer frame 21 and being connected to the second mounting arm 52 in a movable manner respectively, the third shaft piece and the fourth shaft piece having a co-axis with the second axis, in which the second driving mechanism drives at least one of the third shaft piece and the fourth shaft piece to rotate. Furthermore, the second rotation mechanism 40 further includes: two second damping rubber mats (not shown in the figures), the two second damping rubber mats being installed on the third shaft piece and the fourth shaft piece respectively. The second damping rubber mat may also achieve the object of reducing vibration and noise. The second damping rubber mat may be the same with the first damping rubber mat 36 described above.

Preferably, the second driving mechanism includes a second driving electric motor 44 and a second gear pair 43. The output shaft of the second driving electric motor 44 is provided with a second gear 45. The second gear pair 43 is formed as a sector. A first end of the second gear pair 43 has a second tooth 46 engaged with the second gear 45 and a second end thereof is fixed on the third shaft piece.

Because the two opposite ends of the second mounting arm 52 are installed to the third shaft piece and the fourth shaft piece in a rotation manner respectively, and the third shaft piece and the fourth shaft piece are fixedly connected to the outer frame 21, which results that it is rotatable between the outer frame 21 and the second mounting arm 52. When the second gear pair 43 is driven to rotate by the second driving electric motor 44, the second gear pair 43 and the third shaft piece rotate together related to the corresponding ends of the second mounting arm 52, at the same time, the fourth shaft piece rotates related to the corresponding end of the mounting arm 52. Thus, the outer frame 21 may be rotatable in the second plane related to the second mounting arm 52.

Preferably, a central angle of a sector of the second gear pair 43 is greater than a central angle of the sector of the first gear pair 32. In order to make the second gear pair 43 not prevent the rotation of the outer frame 21, the second gear pair 43 bends as a shape of a spherical surface, a radian of the second gear pair 43 coincides with that of the outer frame 21.

An end of the second mounting arm 52 corresponding to the second gear pair 43 is provided with a fixed arm 47. The second driving electric motor has two lugs 48. The two lugs 48 are connected to the fixed arm 47 by a second fixing piece (not shown in the figures) so as to fix the second driving electric motor 44 on the fixed arm 47. Alternatively, the second fixing piece is a screw, a rivet or a pin.

Figure 3:
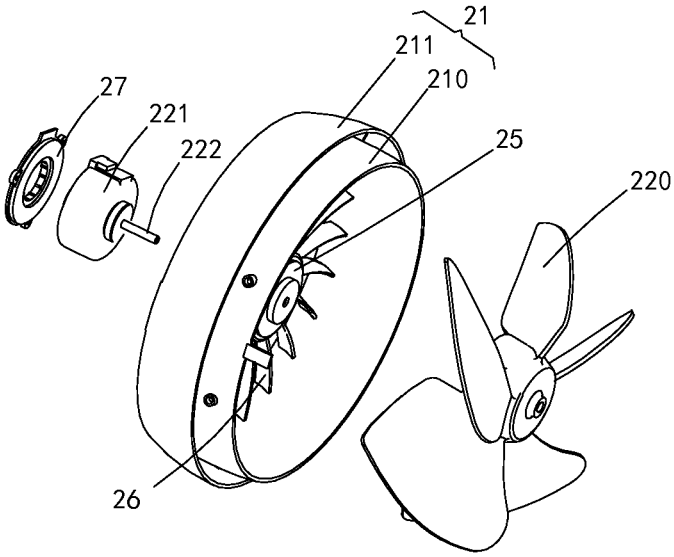
FIG. 3 is a steric exploded view from another angle showing an impeller assembly of an air conditioner indoor unit of FIG. 1.

Referring to FIG. 3 and FIG. 4, in order to make the installation of the third shaft piece and the fourth shaft piece not interfere with the annular wall 12. The outer frame 21 includes a first frame part 210 and a second frame part 211 installed outward on the first frame part 210, the third shaft piece and the fourth shaft piece are connected to the first frame part 210 of the outer frame 21, and two opposite ends of the second mounting arm 52 extend into a space between the first frame part 210 and the second frame part 211. In the further embodiments, the outer frame 21 may not include the first frame part 210 and a second frame part 211, but only has one layer structure, and the gap between the outer frame 21 and the annular wall 12 is designed a little big, or a portion of the third shaft piece and the fourth shaft piece extending away from the outer frame 21 shrinks, which may also solve the problem of the third shaft piece and the fourth shaft piece interfering with the annular wall 12. Of course, for air supply in one plane, the outer frame 21 may be a two layers structure including the first frame part 210 and the second frame part 211, also may be a single layer structure.

In some alternative embodiments of the present disclosure, there is at least one air supply apparatus 20. In other alternative embodiments of the present disclosure, there is a plurality of air outlets 11 and a plurality of air supply apparatuses 20, and the plurality of air outlets 11 correspond to the plurality of air supply apparatuses 20 respectively, and each air supply apparatus 20 pivots about an axis of a corresponding air outlet 11. In other words, the housing 10 may be provided with two or more than two air outlets 11, and the air supply apparatus 20 described above is provided at each air outlet 11 so that the air conditioner indoor unit 110 carries out large angle air supply. For the plurality of air outlets 11, each air outlet 11 may be provided on the air supply apparatus supplying air in two different planes, each air outlet 11 may be provided on the air supply apparatus supplying air in a single plane, also, a portion of the air outlets 11 may be provided on the air supply apparatus supplying air in the first plane, some air outlets 11 may be provided on the air supply apparatus supplying air in the second plane, e.g. the combination of the air supply apparatus shown in FIG. 4 and FIG. 5. Anyway, according to the requirement of the air supply, the air supply apparatus placed at the air outlet 11 may supply air in two planes, or in a single plane, or in combination of the two different single planes.

In addition, the air conditioner indoor unit according to the embodiments of the present disclosure may be an air conditioner with an air outlet located on a top thereof, a hanging conditioner or a floor type conditioner.

The air conditioner indoor unit according to the embodiments of the present disclosure will be described below with reference to FIG. 1, and FIG. 12-FIG. 22 respectively.

Embodiment 1

Figure 2:
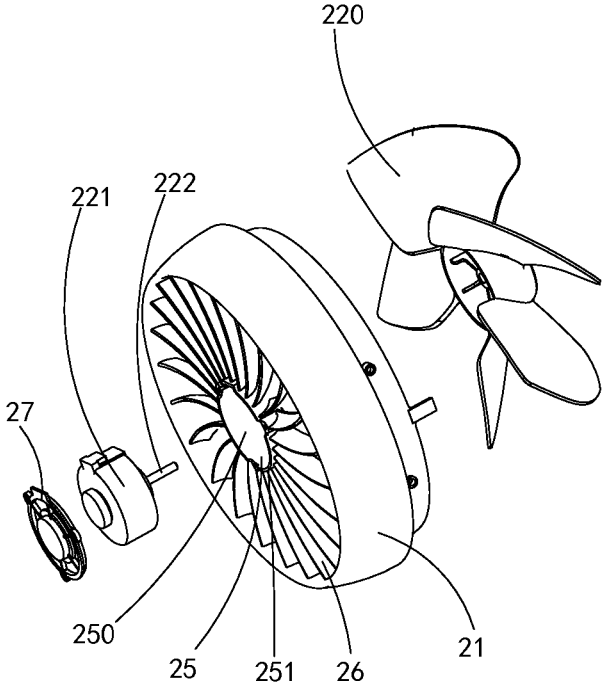
FIG. 2 is a steric exploded view showing an impeller assembly of an air conditioner indoor unit of FIG. 1.

As shown in FIG. 1, the air conditioner indoor unit 110 is an air conditioner with an air outlet located on a top thereof, the housing 10 is only provided with one air outlet 11, and the periphery of the housing 10 is provided with an air inlet 14. The evaporator 28 is provided to be substantially annular along the air inlet 14 so that the air flow passing through the air inlet 14 into the housing 10 may perform heat transfer with the evaporator 28.

Figure 9:
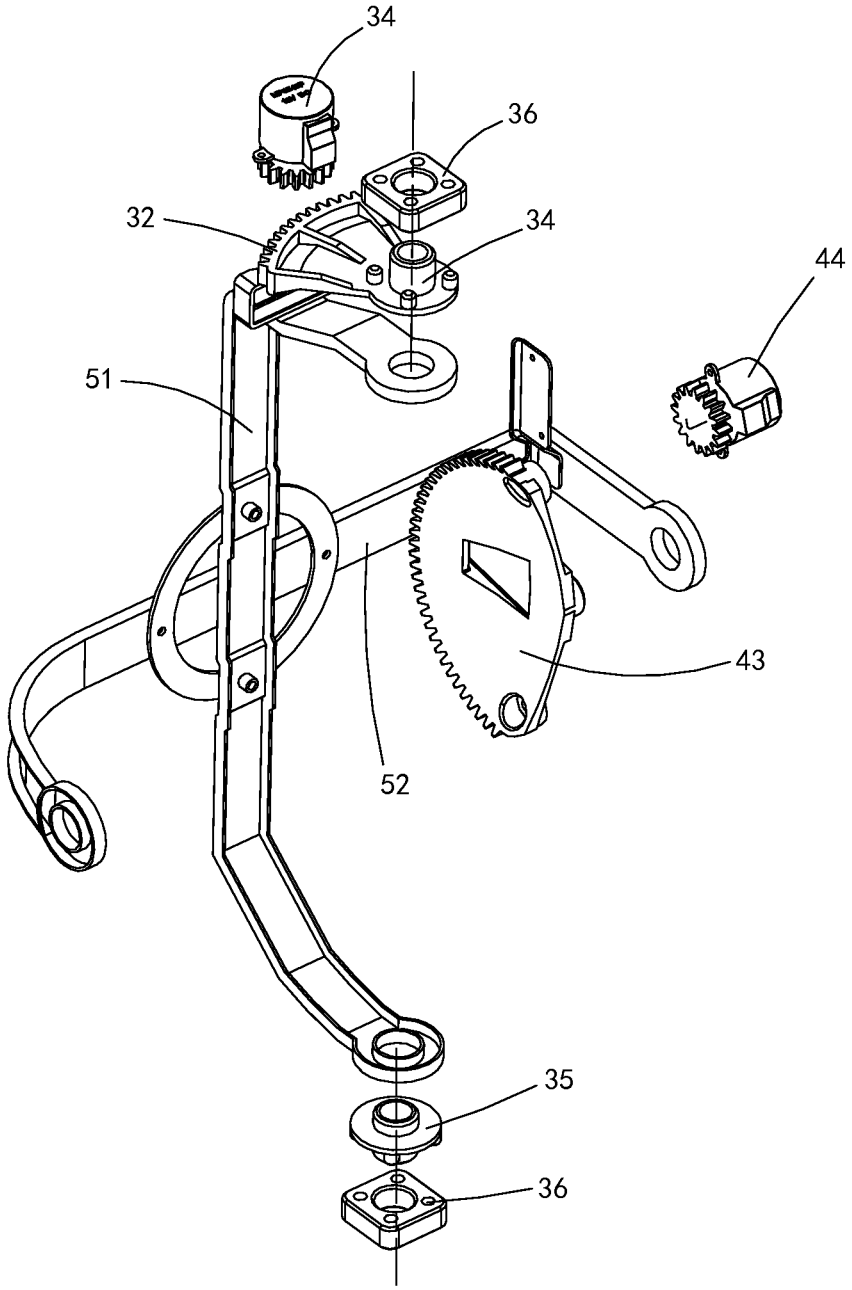
FIG. 9 is a steric exploded view from another angle showing a rotation apparatus of FIG. 8.
Figure 10:
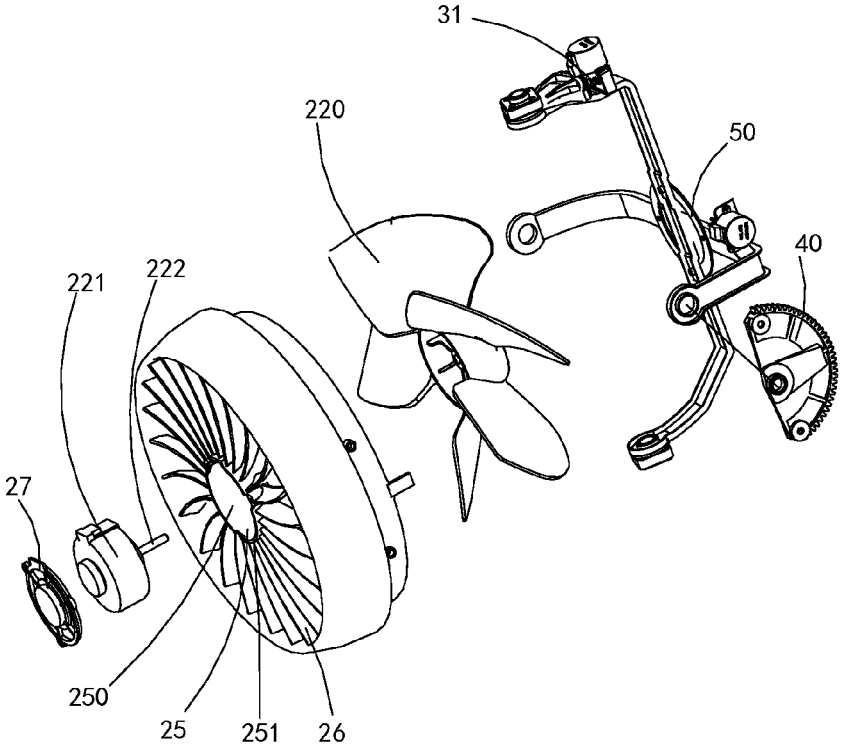
FIG. 10 is a steric exploded view showing an air supply apparatus and a rotation apparatus of FIG. 6 and FIG. 7.
Figure 12:
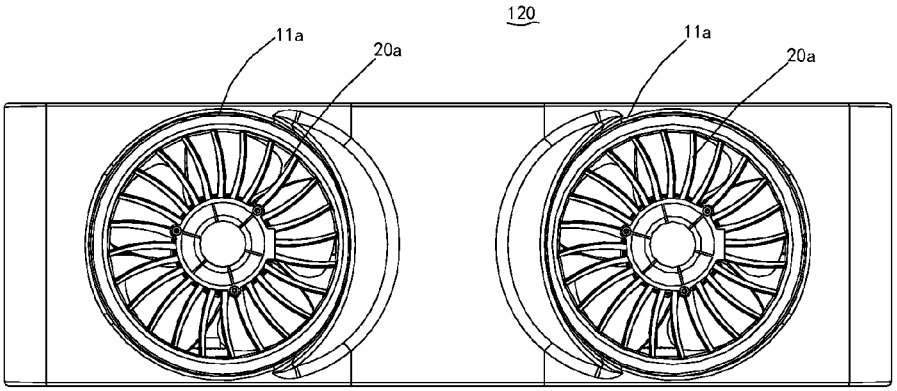
FIG. 12 is a structure schematic view showing an air conditioner indoor unit according to the second embodiment of the present disclosure, in which the air conditioner indoor unit is a hanging conditioner.
Figure 13:
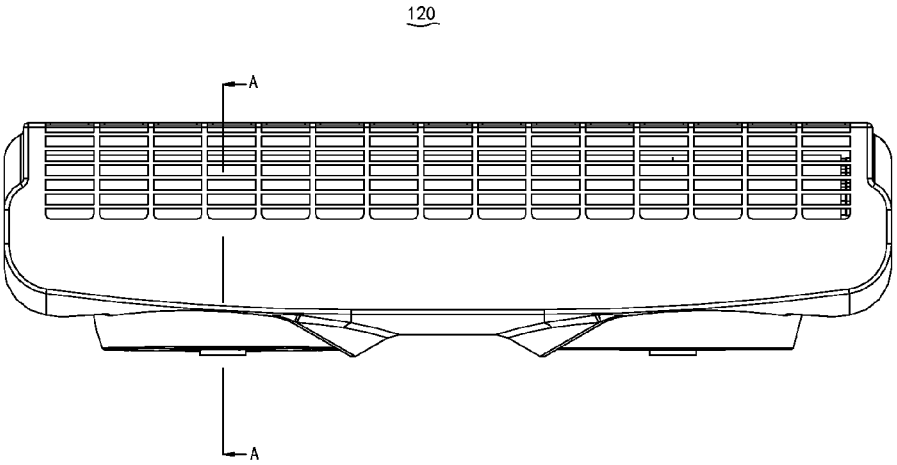
FIG. 13 is a top view showing an air conditioner indoor unit of FIG. 12.

In the present embodiment, the housing 10 is only provided with one air outlet 11 therein and is only provided with one air supply apparatus 20. In other embodiments, the housing 10 of the air conditioner indoor unit 110 may be provided with several other air outlets. The air conditioner indoor unit further includes several independent air supply units formed in the several other air outlets of the housing 10 so as to change the draught direction, every independent air supply unit having the same structure of the air supply apparatus 20, such as shown in FIG. 9 and FIG. 12. It should be understood that, the housing 10 may be provided with more than two air outlets, and one air supply apparatus 20 is provided at every air outlet. With the combination of air supply of each air supply apparatus 20, the air conditioner indoor unit supplies air more freely and the range of the air supply is bigger.

Embodiment 2

Figure 16:
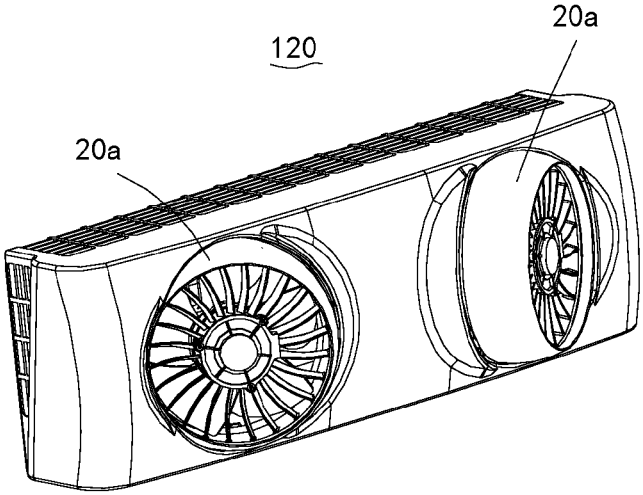
FIG. 16 shows both of the air supply apparatuses of an air conditioner indoor unit of FIG. 12 supply air upwards.
Figure 17:
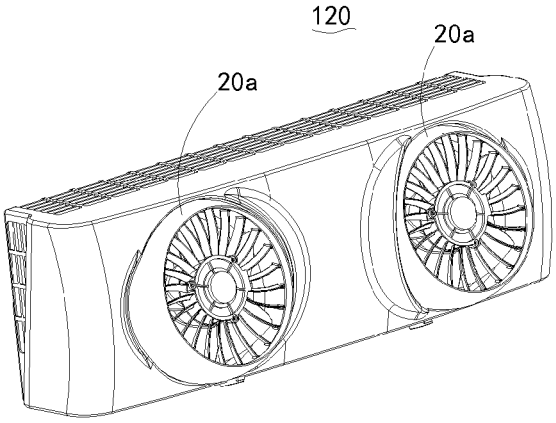
FIG. 17 shows both of the air supply apparatuses of an air conditioner indoor unit of FIG. 12 supply air downwards.
Figure 18:
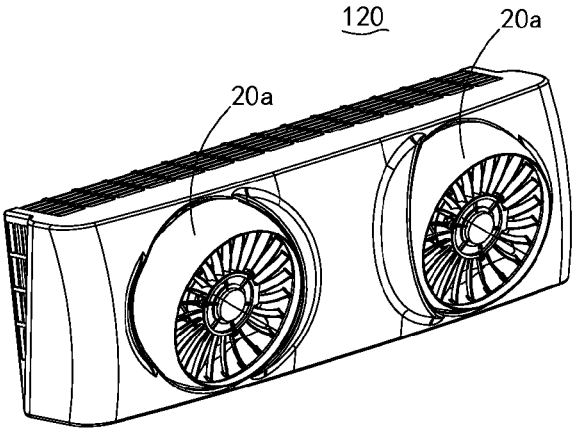
FIG. 18 is a cross-section view of another structure taken along a line A-A of the air conditioner indoor unit of FIG. 13.

In the present embodiment, the air conditioner indoor unit is a hanging conditioner. As shown in FIG. 12-FIG. 18, the wall-hanging type conditioner indoor unit 120 is formed by using two air supply apparatuses 20 described above, e.g. the wall-hanging type conditioner indoor unit 120 is provided with two air outlets 11*a* side by side, and one air supply apparatus 20*a* is installed at every air outlet 11. FIG. 16 shows two air supply apparatuses 20 supplying air to the left-right opposite directions, and FIG. 17 and FIG. 18 show two air supply apparatuses 20 supplying air upwards or downwards respectively. It should be understood that the rotation of two air supply apparatuses 20 may be close to each other, and two air supply apparatuses 20 supply air to the region therebetween so as to carry out the concentration of air supply.

Figure 15:
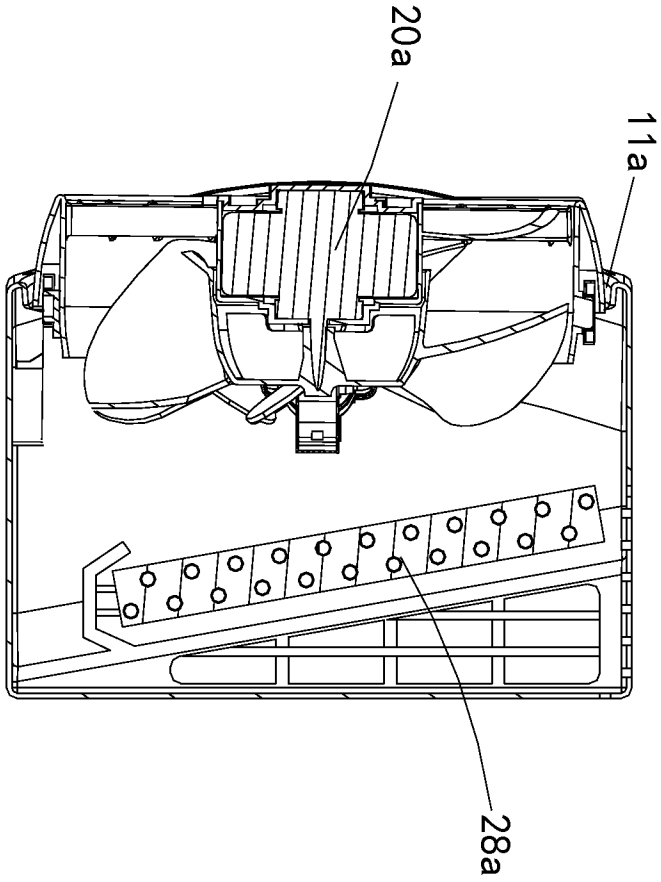
FIG. 15 shows two air supply apparatuses of an air conditioner indoor unit of FIG. 12 supply air in the opposite direction.

As shown in FIG. 15, the evaporator 28*a* is located at the air suction side of the air supply apparatus 20*a* in inclination. The evaporator 28*a* is a straight and tube fin evaporator.

Figure 6:
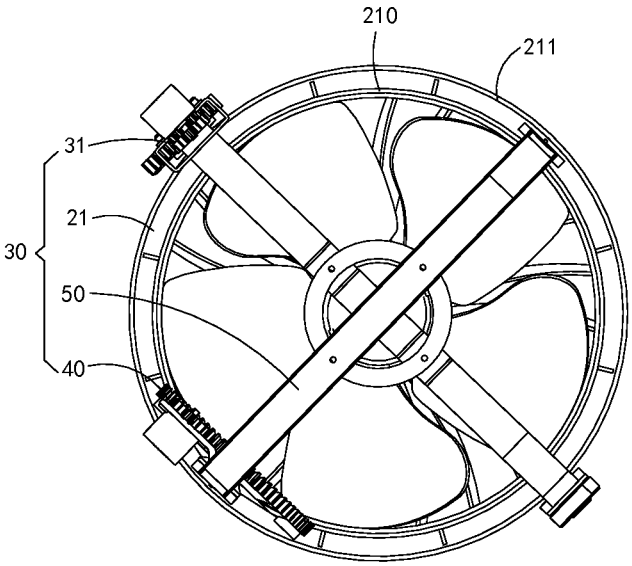
FIG. 6 is a schematic view showing an air supply apparatus and a rotation apparatus of an air conditioner indoor unit according to a further embodiment of the present disclosure.
Figure 7:
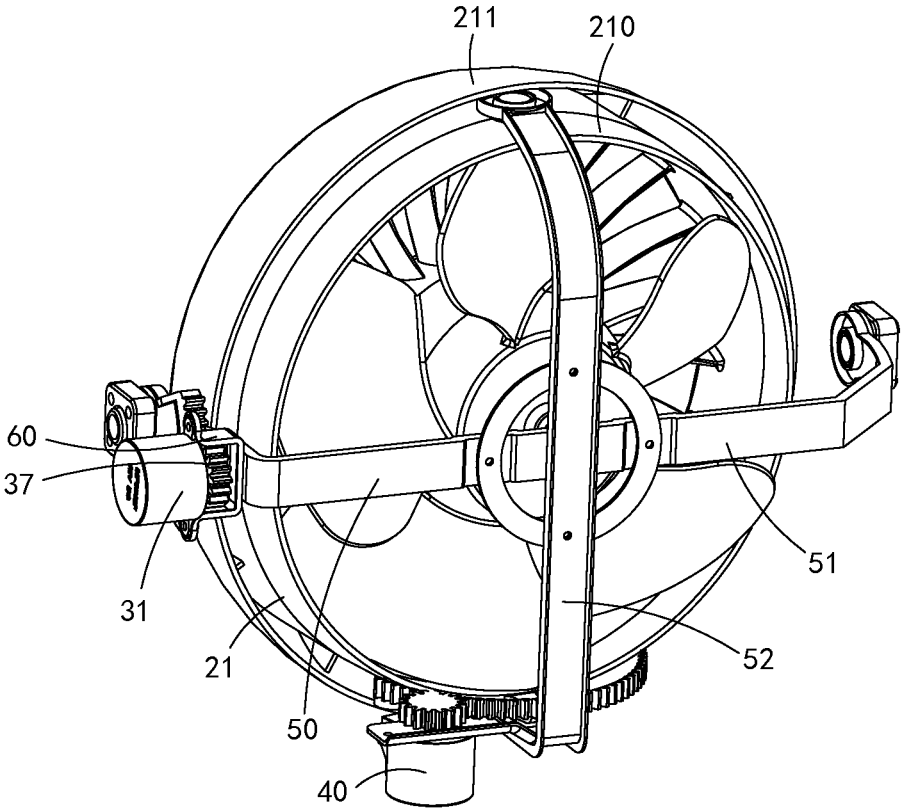
FIG. 7 is a schematic view from another angle showing an air supply apparatus and a rotation apparatus of FIG. 6.
Figure 8:
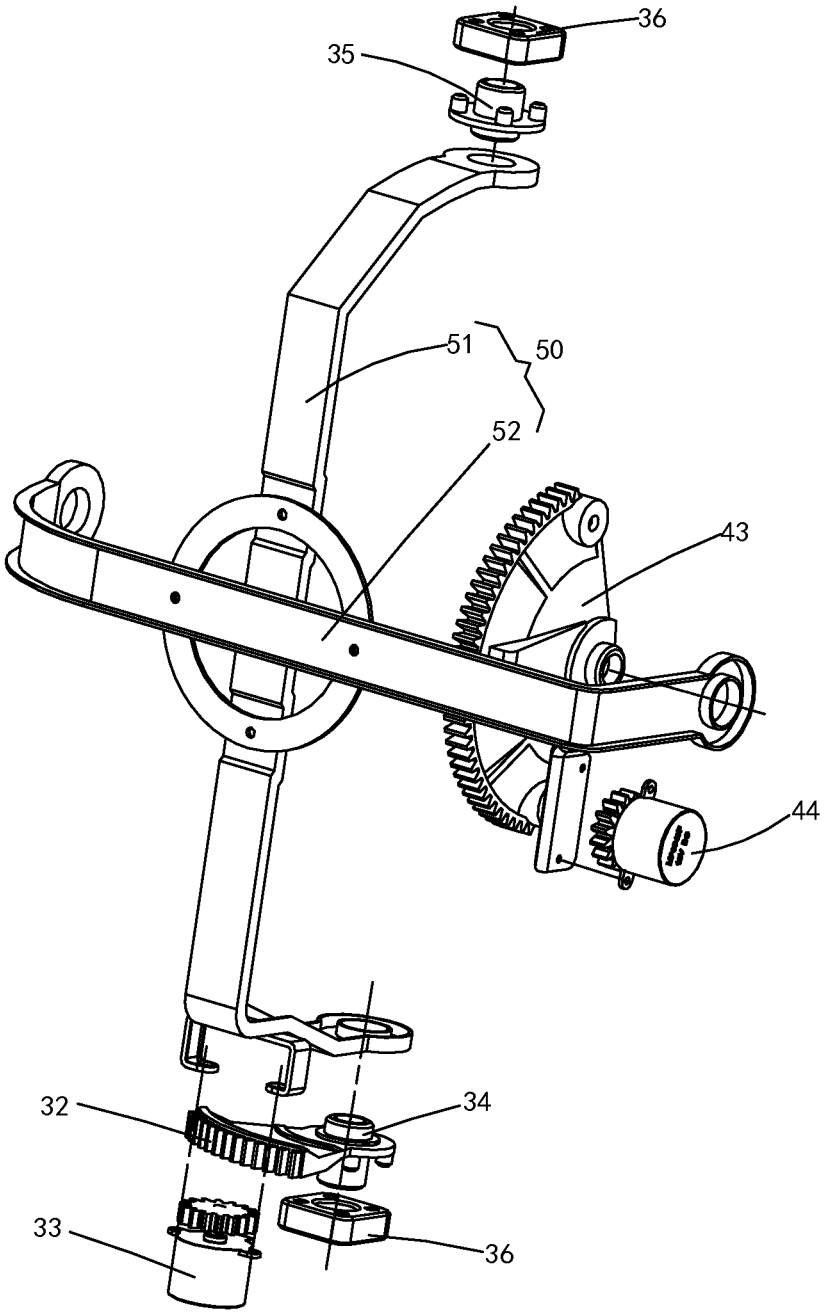
FIG. 8 is a steric exploded view showing a rotation apparatus of FIG. 6 and FIG. 7.

In the air conditioner indoor unit 120 of the second embodiment, the air supply apparatus 20*a* may be the air supply apparatus shown in FIG. 6 and FIG. 7, or the air supply apparatus shown in FIG. 4 and/or FIG. 5. For the air supply apparatuses shown in FIG. 12, the two air supply apparatuses may be the air supply apparatus shown in FIG. 6 and FIG. 7, or may be the air supply apparatus shown in FIG. 7. For the air supply apparatuses shown in FIG. 13 and FIG. 14, the two air supply apparatuses may be the air supply apparatus shown in FIG. 6 and FIG. 7, or may be the air supply apparatus shown in FIG. 5. Of course, one of the two air supply apparatuses may be the air supply apparatus shown in FIG. 5, the other one may be the air supply apparatus shown in FIG. 7. In other words, one air supply apparatus is responsible for left-right air supply, and the other one is responsible for up-down air supply. The designer may use the combination of the air supply apparatus shown in FIG. 6, FIG. 4 and FIG. 5 based on the needs of the air supply.

Figure 11:
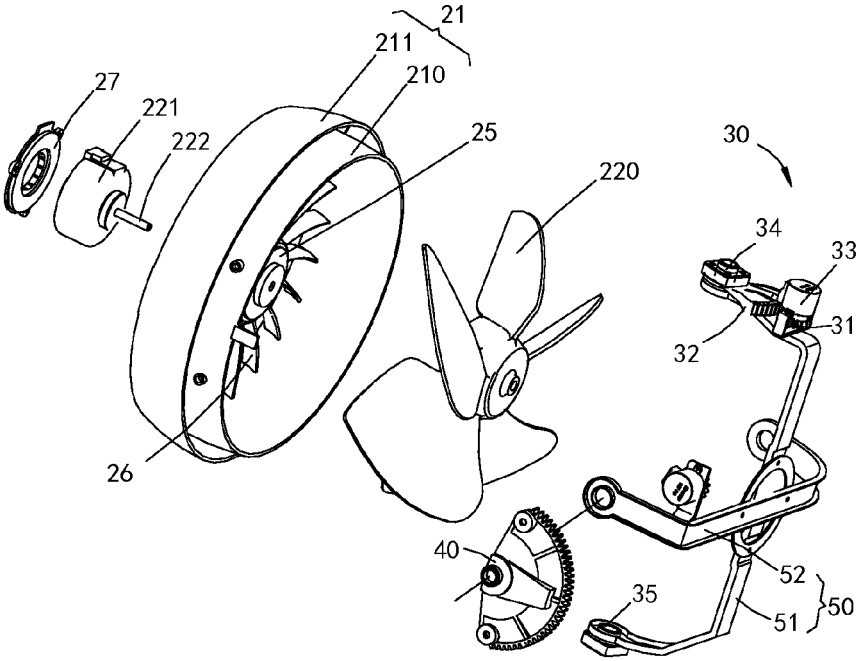
FIG. 11 is a steric exploded view with another angle showing an air supply apparatus and a rotation apparatus of FIG. 6 and FIG. 7.
Figure 14:
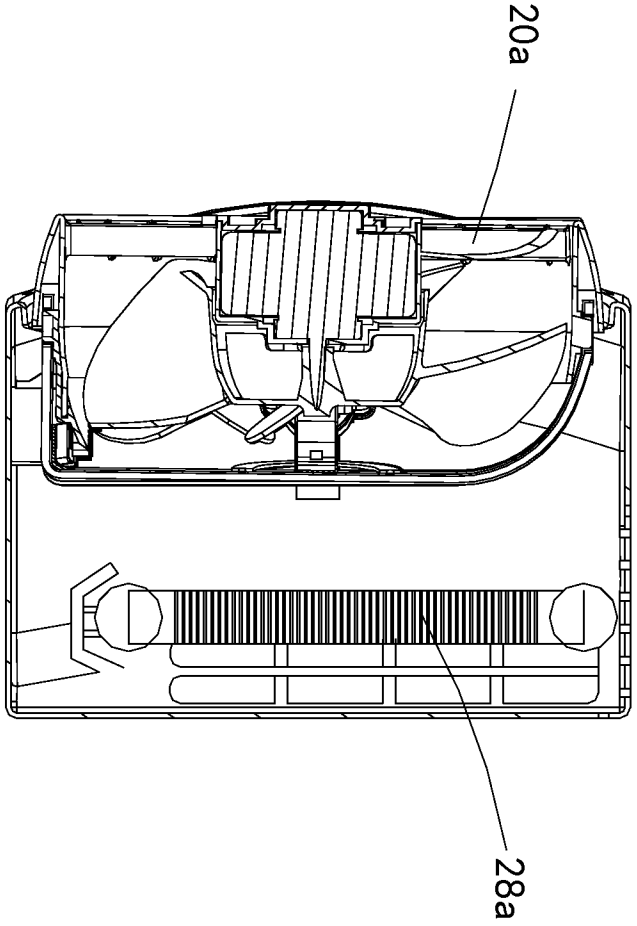
FIG. 14 is a cross-section view taken along a line A-A of the air conditioner indoor unit of FIG. 13.

FIG. 14 shows another structure of the cross-section of the air conditioner indoor unit 120 provided by the second embodiment, in which, the cross-section shown in FIG. 14 is approximately same with that shown in FIG. 11, the difference therebetween is that the evaporator 28 used in FIG. 14 is a micro-channel parallel flow evaporator. It should be understood that the evaporator 28*a* used for the air conditioner indoor unit 120 provided by the second embodiment may be a multifolded evaporator about the air suction side of the air supply apparatus.

Embodiment 3

Figure 19:
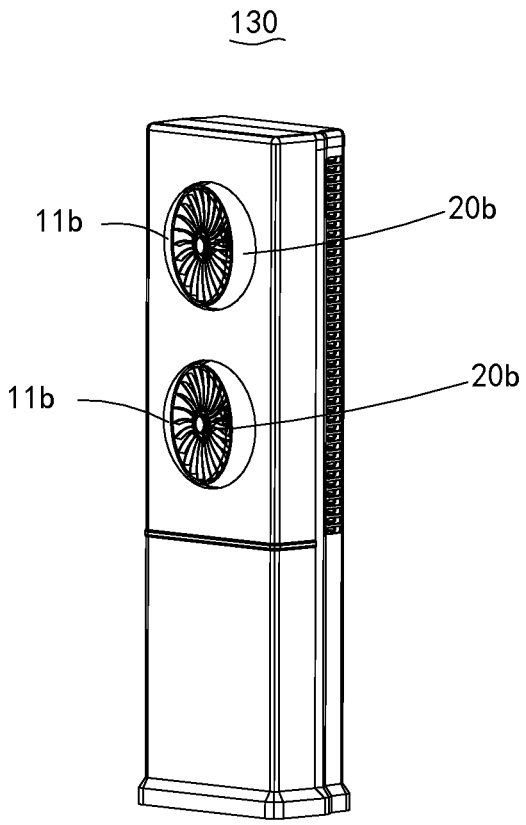
FIG. 19 is a structure schematic view showing an air conditioner indoor unit according to the third embodiment of the present disclosure, in which both of the air supply apparatuses supply air to the left.
Figure 20:
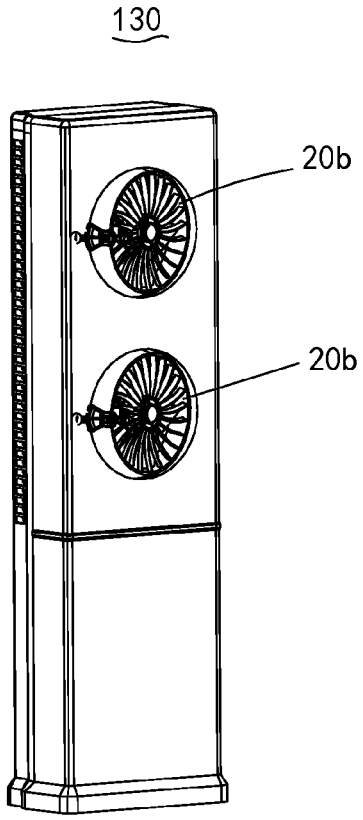
FIG. 20 shows both of the air supply apparatuses of an air conditioner indoor unit of FIG. 19 supply air to the right.
Figure 21:
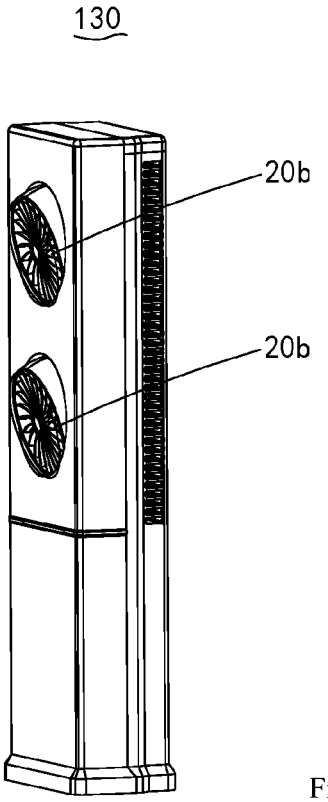
FIG. 21 shows both of the air supply apparatuses of an air conditioner indoor unit of FIG. 19 supply air downwards.
Figure 22:
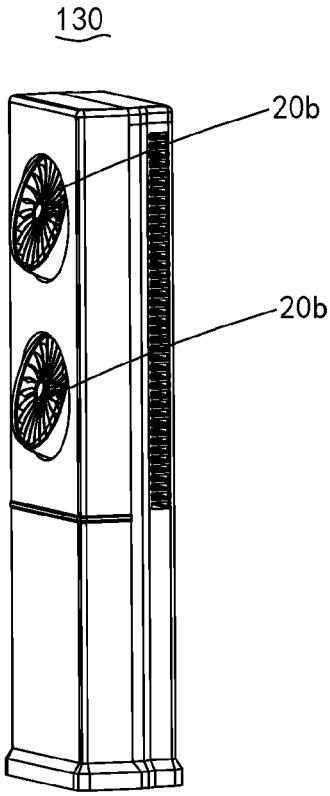
FIG. 22 shows both of the air supply apparatuses of an air conditioner indoor unit of FIG. 19 supply air upwards.
Figure 23:
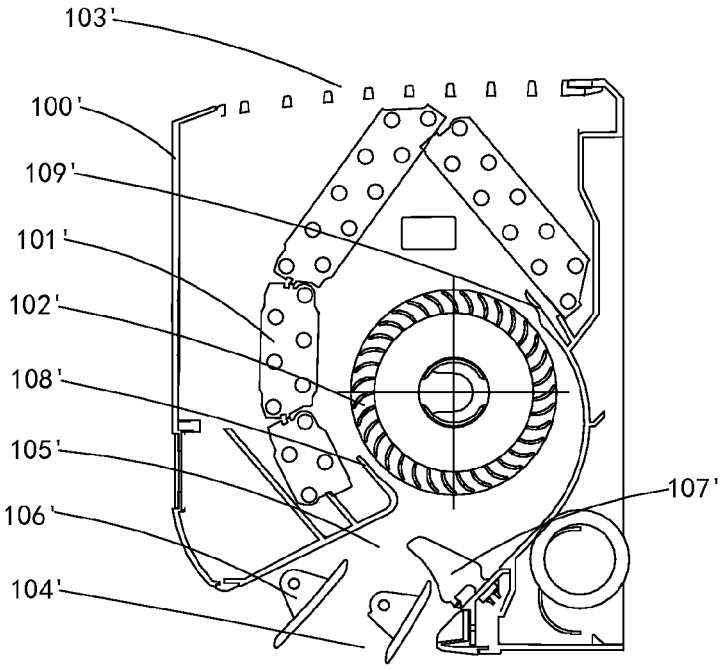
FIG. 23 is a structure schematic view showing an air conditioner indoor unit in the state of the art.

In the present embodiment, the air conditioner indoor unit is a floor type air conditioner. The air conditioner indoor unit 130 is provided with two air outlets 11*b* side by side, and one air supply apparatus 20*b* is installed at every air outlet 11*b*. The floor type air conditioner indoor unit 130 formed by using two air supply apparatuses 20 described above is shown in FIG. 19-FIG. 22. FIG. 19 and FIG. 20 show two air supply apparatuses 20 supplying air to the left and to the right respectively, and FIG. 21 and FIG. 22 show the air supply apparatuses 20 supplying air upwards and downwards respectively. It should be understood that the rotation of two air supply apparatuses 20 may be close to each other, and two air supply apparatuses 20 supply air flow to the region therebetween so as to carry out the concentration of air supply. Of course, for the floor type air conditioner indoor unit 130, the evaporator may also use a straight tube fin evaporator, a micro-channel parallel flow evaporator or a multifolded evaporator.

Similarly, in the air conditioner indoor unit 130 of the third embodiment, the air supply apparatus 20*b* may be the air supply apparatus shown in FIG. 6 and FIG. 7, or may be the air supply apparatus shown as FIG. 4 and/or FIG. 5. For the air supply shown in FIG. 19 and FIG. 20, the two air supply apparatuses 20*b* may be the air supply apparatus shown in FIG. 3 and FIG. 4, or both of the air supply apparatuses may be the air supply apparatus shown in FIG. 4. For the air supply shown in FIG. 21 and FIG. 22, the two air supply apparatuses 20*b* may be the air supply apparatus shown in FIG. 6 and FIG. 7, or both of the air supply apparatuses may be the air supply apparatus shown in FIG. 5. Of course, one of the two air supply apparatuses may be the air supply apparatus shown in FIG. 5, the other one may be the air supply apparatus shown in FIG. 7. In other words, one air supply apparatus is responsible for left-right air supply, and the other one is responsible for up-down air supply. The designer may use the combination of the air supply apparatus shown in FIG. 6, FIG. 4 and FIG. 5 based on the needs of the air supply.

Reference throughout this specification to "an embodiment," "some embodiments," "one embodiment", "an example," "a specific example," or "some examples," means that a particular feature, structure, material, or characteristic described in connection with the embodiment or example is included in at least one embodiment or example of the present disclosure. Thus, the appearances of the phrases described above throughout this specification are not necessarily referring to the same embodiment or example of the present disclosure. Furthermore, the particular features, structures, materials, or characteristics may be combined in any suitable manner in one or more embodiments or examples.

Although explanatory embodiments have been described for the lens assembly, shown and described, it would be appreciated by those skilled in the art that changes, amendments, alternatives and modifications can be made without departing from principles and spirit of the present disclosure. The scope of the present disclosure is defined by the claims and the like.

What is claimed is:

1. An air conditioner indoor unit, comprising:

a housing having an air outlet channel;

an air supply apparatus used for an air conditioner comprising:

an annular outer frame having an outer surface formed as a partial spherical surface and having an accommodating space therein, an impeller assembly provided in the accommodating space and pivotally connected to the outer frame, wherein the impeller assembly has an air suction side and an air outlet side, a central part disposed in the accommodating space and coaxially provided with the outer frame, and a plurality of air guide blades arranged along a circumferential direction in the accommodating space, and an outer end of each air guide blade being connected to an inner surface of the outer frame and an inner end of each air guide blade being connected to an outer surface of the central part, wherein the impeller assembly comprises: an impeller; an electric motor driving the impeller, the electric motor being installed in the central part, an output shaft of the electric motor being connected to the impeller through the central part;

wherein the air supply apparatus is disposed in the air outlet channel and rotatable related to the housing; and an evaporator disposed in the housing and located at the air suction side of the impeller assembly of the air supply apparatus, wherein the air outlet channel has an air outlet, an annular wall is provided at the air outlet, an inner surface of the annular wall is formed as a partial spherical surface, and the outer frame of the air supply apparatus is connected to the annular wall in a pivotal manner by a rotation apparatus, and wherein the air supply apparatus is rotatable along at least one axis of the air outlet, wherein the rotation apparatus comprises: a first rotation mechanism connected to the annular wall in a movable manner; and a first driving mechanism driving the first rotation mechanism to rotate about a first axis, wherein the first rotation mechanism comprises: a first shaft piece and a second shaft piece, the first shaft piece and the second shaft piece being disposed between the outer frame and the annular wall and provided on two opposite sides of the outer frame, respectively, the first shaft piece and the second shaft piece being connected to the outer frame and to the annular wall in a movable manner respectively, the first shaft piece and the second shaft piece having a co-axis with the first axis, wherein the first driving mechanism drives at least one of the first shaft piece and the second shaft piece to rotate, wherein the first driving mechanism comprises: a first driving electric motor, an output shaft of the first driving electric motor being provided with a first gear; a first gear pair, the first gear pair being formed as a sector, a first end of the first gear pair having a first tooth engaged with the first gear and a second end being fixed on the first shaft piece, wherein the rotation apparatus further comprises a mounting bracket, the mounting bracket comprising a first mounting arm fixed to the outer frame, wherein the first shaft piece and the second shaft piece are connected to both ends of the first mounting arm respectively.

2. The air conditioner indoor unit according to claim 1, wherein the plurality of air guide blades is located at the air outlet side of the impeller assembly.

3. The air conditioner indoor unit according to claim 1, wherein the central part comprises a casing with a groove, the groove being concave facing the air outlet side, wherein the electric motor is installed in the groove and the output shaft is connected to the impeller through a bottom wall of the groove.

4. The air conditioner indoor unit according to claim 1, wherein a spherical center of the annular wall coincides with that of the outer frame.

5. The air conditioner indoor unit according to claim 1, wherein the first rotation mechanism further comprises:

two first damping rubber mats, the two first damping rubber mats being installed on the first shaft piece and the second shaft piece respectively.

6. The air conditioner indoor unit according to claim 1, wherein an end of the first mounting arm corresponding to the first gear pair is provided with two support arms, the two support arms are extended outward from the corresponded end of the first mounting arm respectively, and free ends of the two support arms bend inward, facing each other, so as to form two fixing lugs; the first driving electric motor is provided with two mounting lugs, the two fixing lugs and the two mounting lugs are connected by a first fixing piece so as to install the first driving electric motor on the first mounting arm.

7. The air conditioner indoor unit according to claim 1, wherein the mounting bracket further comprises a second mounting arm fixed to the first mounting arm in a cross manner, both ends of the second mounting arm being fixed with the annular wall respectively; the rotation apparatus further comprises:

a second rotation mechanism connected to the second mounting arm in a movable manner; and a second driving mechanism driving the second rotation mechanism to rotate about a second axis, wherein the second rotation mechanism comprises: a third shaft piece and a fourth shaft piece, the third shaft piece and the fourth shaft piece being disposed between the outer frame and the annular wall and provided on two opposite sides of the outer frame respectively, the third shaft piece and the fourth shaft piece being fixed to the outer frame and being connected to the second mounting arm in a movable manner respectively, the third shaft piece and the fourth shaft piece having a co-axis with the second axis, wherein the second driving mechanism drives at least one of the third shaft piece and the fourth shaft piece to rotate, wherein the second driving mechanism comprises: a second driving electric motor, an output shaft of the second driving mechanism being provided with a second gear; a second gear pair, the second gear pair being formed as a sector, a first end of the second gear pair having a second tooth engaged with the second gear and a second end being fixed on the third shaft piece.

8. The air conditioner indoor unit according to claim 7, wherein the second rotation mechanism further comprises:

two second damping rubber mats, the two second damping rubber mats being installed on the third shaft piece and the fourth shaft piece respectively.

9. The air conditioner indoor unit according to claim 7, wherein an end of the second mounting arm corresponding to the second gear pair is provided with a fixed arm, the second driving electric motor having two lugs, the two lugs are connected to the fixed arm by a second fixing piece so as to fix the second driving electric motor on the fixed arm.

10. The air conditioner indoor unit according to claim 7, wherein the outer frame comprises a first frame part and a second frame part installed outward on the first frame part, the third shaft piece and the fourth shaft piece being connected to the first frame part, and both ends of the second mounting arm extending into a space between the first frame part and the second frame part.

* * * * *